US009470005B2

(12) United States Patent
Schwoerer

(10) Patent No.: US 9,470,005 B2
(45) Date of Patent: Oct. 18, 2016

(54) PANEL FORMWORK SYSTEMS FOR FORMING T-SHAPED INTERSECTIONS USING PANEL FORMWORK ELEMENTS WITH CENTRALLY LINED UP TIE HOLES

(71) Applicant: Peri GmbH, Weissenhorn (DE)

(72) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 5 days.

(21) Appl. No.: 13/723,218

(22) Filed: Dec. 21, 2012

(65) Prior Publication Data

US 2013/0119229 A1 May 16, 2013

Related U.S. Application Data

(62) Division of application No. 12/449,511, filed as application No. PCT/DE2008/000190 on Feb. 2, 2008, now Pat. No. 8,360,389.

(30) Foreign Application Priority Data

Feb. 13, 2007 (DE) ..... 10 2007 006 907

(51) Int. Cl.
*E04G 17/00* (2006.01)
*E04G 11/08* (2006.01)

(52) U.S. Cl.
CPC ..... *E04G 17/00* (2013.01); *E04G 11/087* (2013.01); *E04G 17/001* (2013.01)

(58) Field of Classification Search
USPC ..... 249/33, 34, 40, 41, 42, 43, 44, 45, 46, 249/47, 194, 26, 27
See application file for complete search history.

(56) References Cited

U.S. PATENT DOCUMENTS

| | | | | | |
|---|---|---|---|---|---|
| 677,649 | A | * | 7/1901 | Farrell | 249/44 |
| 842,722 | A | * | 1/1907 | Swinnerton | 249/43 |
| 1,103,109 | A | * | 7/1914 | Venable | 249/27 |
| 1,271,874 | A | * | 7/1918 | English | 249/27 |
| 1,487,963 | A | * | 3/1924 | Meares | 249/22 |
| 2,017,553 | A | * | 10/1935 | Troiel | 249/19 |
| 2,019,195 | A | * | 10/1935 | Simpson | 249/43 |
| 2,352,783 | A | * | 7/1944 | Geer | 249/27 |
| 2,511,584 | A | * | 6/1950 | Hill | 249/27 |
| 2,523,131 | A | * | 9/1950 | Martin | 249/42 |
| 6,502,802 | B2 | * | 1/2003 | Jorn et al. | 249/194 |

* cited by examiner

*Primary Examiner* — Michael Safavi
(74) *Attorney, Agent, or Firm* — Paul Vincent

(57) ABSTRACT

A panel formwork T-shaped arrangement has panel formwork elements 61, 62 directly bordering an intermediate panel formwork compensation element 53. The associated formlinings 61*a*, 53*a*, 62*a* are in one plane. These formlinings 61*a*, 53*a*, 62*a* delimit on one side the continuous wall 84 of the T-shaped intersection to be produced. The three components 61, 53, 62 are engaged from behind by a crossbar 85 for mechanical stabilization. The two formlinings 55*a*, 57*a* delimit on both sides the abutting wall 86 of the T-shaped intersection to be produced. The lateral outer edges 12 and 17 of the inner limb 56 and the panel formwork element 61 are aligned with respect to each other at the edge plane R. The outer edges 78 and 81 of the inner limb 58 and the panel formwork element 62 are also aligned with respect to each other at the edge plane R'.

7 Claims, 6 Drawing Sheets

PANEL FORMWORK SYSTEMS FOR FORMING T-SHAPED INTERSECTIONS USING PANEL FORMWORK ELEMENTS WITH CENTRALLY LINED UP TIE HOLES

This application is a divisional of Ser. No. 12/449,511 filed Aug. 11, 2009 as the national stage of PCT/DE2008/00190 filed on Feb. 2, 2008 and also claims Paris Convention priority of DE 10 2007 006 907.5 filed on Feb. 13, 2007. The entire disclosures of all those applications are hereby incorporated by reference.

BACKGROUND OF THE INVENTION

The invention concerns panel formwork systems and associated panel formwork arrangements for producing corners and T-shaped intersections of concrete walls by means of a panel formwork.

Panel formwork corner systems are known in the art.

Formworks are used, in particular, for producing concrete walls. The formwork thereby confines a space in which the concrete wall is to be formed. This space is filled with liquid concrete. When the concrete has hardened, the formwork is removed.

Panel formworks enable particularly flexible design of the concrete structures to be erected. A panel formwork is formed by a plurality of individual reusable components that are assembled at the building site in accordance with the respectively desired concrete structure. The most important components of a panel formwork are rectangular panel formwork elements supplemented by panel formwork corner elements.

Rectangular panel formwork elements have a relatively low weight, are easy to stack and can be used in any orientation vertically or horizontally.

The individual components of a panel formwork generally comprise a formlining that faces the liquid concrete, and a (generally circumferential) frame runs on the rear side of the component, which mechanically stabilizes the component. Neighboring components are connected by means of turnbuckles, wherein each turnbuckle engages with the frames.

In addition to panel formworks, there are also conventional girder formworks and steel formworks. They may have a mechanically highly robust design but cannot be used with the same flexibility as the panel formworks.

The liquid concrete that is encased between the oppositely disposed formwork elements exerts pressure on the formlinings due to gravity that attempts to force the formwork elements apart. These expansion forces have a maximum value in the lower formwork region. In order to prevent expansion of the formwork, oppositely disposed formwork elements are connected to each other by so-called tie rods. The tie rods penetrate through the formlinings and through the concrete structure to be produced. The tie rods brace the tie plates that abut the rear side of the formwork elements with respect to each other. When the concrete structure is finished, the tie rods and tie plates are removed.

In a conventional panel formwork series, the tie holes through which the tie rods project, extend through the circumferential frame of the rectangular panel formwork elements (so-called edge anchorage). The tie plates are supported on the frame. A tie plate thereby engages behind the frame of the panel formwork element through which the tie rod extends, and also behind the frame of a neighboring panel formwork element. At this neighboring panel formwork element, one tie hole which is disposed below the tie plate is thereby not used, however, there would not be enough space for mounting another tie rod anyway.

Altogether, only part (typically half) of the tie holes are actually used for the tie rods in these conventional panel formwork elements. The remaining part of the tie holes, which would be used for other orientations of the panel formwork elements, must be closed by stoppers when the formwork is erected in order to prevent leakage of liquid concrete.

The arrangement of stoppers requires a considerable amount of work and induces high costs for the production of concrete walls. Falsely arranged stoppers obstruct arrangement of the tie rods and may require correction. Missing stoppers result in leakage of liquid concrete and clogging of tie holes by hardened concrete.

Previous mounting of nut elements for one-sided tie elements for so-called "one-sided anchorage" causes similar problems as false arrangement of stoppers and may also necessitate correction.

One further conventional panel formwork corner system is substantially based on a comparable edge anchorage. This system for forming an oblique-angled obtuse corner of a concrete wall has an inner corner element, an outer corner element, and also two rectangular panel formwork elements that border on the limbs of the inner corner element (inner limbs). The inner corner element is exclusively anchored on the lateral edge of the inner limbs, overlapping the respectively neighboring panel formwork element. The outer corner element has a tie catch in each limb (outer limb), which is utilized for anchoring the inner corner element, and also an edge anchorage that anchors the outer edge of the opposite rectangular panel formwork element.

In this conventional panel formwork corner system, stoppers must be inserted in tie holes that are not used, in particular, in the outer corner element, in the panel formwork elements that belong to the corner system, and in the panel formwork elements that directly border the corner system. False mounting necessitates correction. The same applies for previous mounting of nut elements.

It is therefore the underlying purpose of the present invention to provide a panel formwork corner system that enables erection of a panel formwork with reduced effort, in particular wherein false positioning of stoppers and nuts in and on the tie holes is prevented.

SUMMARY OF THE INVENTION

This object is achieved by a panel formwork corner system comprising a) a panel formwork inner corner element, with two inner limbs that are connected to each other and arranged at an angle with respect to each other, wherein the outer side of each inner limb has a flat formlining, wherein the formlinings of the two inner limbs subtend an angle $\alpha 1$, wherein an inner side of each inner limb has a frame section that extends along a lateral outer edge of the inner limb facing away from the respectively other inner limb, wherein each inner limb has at least one tie hole that extends through the formlining of the inner limb, and wherein each tie hole of an inner limb is disposed at a separation from the frame section of this inner limb, b) a panel formwork outer corner element with two outer limbs that are rigidly connected to each other and disposed at an angle with respect to each other, wherein an inner side of each outer limb has a flat formlining, wherein the two formlinings of the outer limbs subtend an angle $\alpha 2$, with $\alpha 1=\alpha 2$, and wherein the outer corner element has no tie holes, c) two rectangular panel formwork elements, each being formed with a flat formlining on a front side of the panel formwork element, with a circumferential frame provided on a rear side of the panel formwork element, with at least one tie hole that extends through the formlining of the panel formwork element, wherein all tie holes of a panel formwork element are disposed in a common tie hole plane, wherein this tie hole plane extends centrally between two parallel lateral outer edges of the rectangular panel formwork element and perpendicularly to the formlining plane, and wherein all tie holes of a panel formwork element are disposed at a separation from the circumferential frame, wherein the position of each tie hole of each inner limb with respect to three lateral outer edges of the inner limb corresponds to the position of a tie hole of a panel formwork element with respect to three lateral outer edges of the panel formwork element and vice versa.

The inventive panel formwork corner system comprises panel formwork corner elements and rectangular panel formwork elements like conventional framework corner systems. The positioning of the tie holes, however, is modified.

The inventive panel formwork corner system is used to produce a corner of a concrete wall. It is moreover designed to be continued on the inner side and outer side by means of rectangular panel formwork elements with centrally lined up tie holes. These continuing panel formwork elements are of the same type as the rectangular panel formwork elements of the inventive panel formwork corner system.

The rectangular panel formwork elements are "centrally anchored", wherein all tie holes of the panel formwork element are lined up in one tie hole plane. The tie hole plane extends centrally between (i.e. at a constant separation from) two of the outer edges of the rectangular panel formwork element. An inventive central tie hole replaces two tie holes on opposite formwork sections according to prior art. This considerably reduces the overall number of tie holes per panel formwork element.

The inner corner element of the inventive panel formwork corner system is correspondingly adjusted. In the mounted state, each inner limb with respect to its upper edge, lower edge and lateral outer edge facing away from the other inner limb is opposed by a rectangular panel formwork element in an aligned fashion. Exactly one tie hole is provided in the panel formwork element for each tie hole in the inner limb at identical relative positions (i.e. separation) with respect to the outer edges. The same applies vice versa, i.e. exactly one tie hole is provided in the inner limb for each tie hole in the panel formwork element at an identical relative position with respect to three outer edges of the panel formwork element.

Consequently, all tie holes of the inner limbs and all tie holes of the panel formwork elements can actually be used for anchoring. Tie holes in the direct vicinity of tie holes of a neighboring component (in particular panel formwork element), wherein only one of the two tie holes is used for anchoring, do not occur in an inventive panel formwork corner system. There is no covering of tie holes by tie plates of neighboring tie plates. The inventive panel formwork corner system only has tie holes that can actually be used for erecting a panel formwork, and typically all tie holes are used for anchoring within the scope of the invention. Thus, stoppers do not need to be placed in the inventive components at all. The associated work is cancelled. Since no stoppers are placed, there cannot be falsely positioned stoppers.

Similarly, false previous mounting of nut elements for one-sided anchorage is prevented in accordance with the invention. One nut element can simply be arranged, i.e. mounted, at each tie hole on one formwork side (or the side of the concrete wall to be erected).

None of the tie holes of an inventive panel formwork corner arrangement is disposed in the frame. This is advantageous in that the tie hole diameter, and thereby also the thickness of the tie rods, can be freely selected. In the prior art, the width of the circumferential frame delimits the maximum tie hole diameter. An enlargement of the tie hole diameter would entail general widening of the frame (with constant frame profile), which would cause an expensive additional steel consumption for producing the panel formwork element. The use of the inventive panel formwork corner system therefore enables production of less expensive formworks that can be anchored more strongly. Larger tie holes that can be easily selected in accordance with the invention also permit greater tie rod play, which is required e.g. for producing wall outer sides that are tilted with respect to each other and formwork elements that are correspondingly tilted with respect to each other.

A concrete wall produced by means of formwork is often not further processed or covered prior to use of the associated building, which is called "exposed concrete wall". An exposed concrete wall still shows the tie holes used for anchoring and also those closed by stoppers ("anchor pattern"). When a panel formwork with inventive panel formwork corner elements is used, one obtains an improved, in particular, more homogeneous anchor pattern for exposed concrete walls. The marks of the stoppers can be completely omitted and the marks of used tie holes are pleasantly disposed at a distance from and centrally between visible joints. The marks of the used tie holes are regularly distributed over the exposed concrete wall.

In accordance with the invention, all tie holes are disposed outside of the circumferential frame or frame section and preferably also at a clear separation from the circumferential frame or frame section of the component (panel formwork element or inner corner element). A tie hole has, in the sense above, a clear separation from the frame when it is disposed at a distance of at least 8 cm from the frame, measured from the closest inner edge of the frame to the axis center of the tie hole and parallel to the formlining plane.

Tie holes in accordance with the present invention are only those tie holes that extend through the formlining, typically approximately perpendicularly through the formlining.

In a preferred embodiment of an inventive panel formwork corner system, at least one rectangular panel formwork compensation element is provided, which can be disposed between an outer limb and a panel formwork element. In particular, two rectangular panel formwork compensation elements may be provided (one for each outer limb). The wall thickness of the concrete wall can be adjusted by the panel formwork compensation elements.

In one particularly preferred embodiment $\alpha 1=\alpha 2=90°$. In other words, the panel formwork corner system is designed for right-angled corners. This is the most frequent case in practice.

In one particularly preferred embodiment, the tie holes of the panel formwork elements are disposed mirror-symmetrically with respect to a cross plane of the respective panel formwork element, wherein the cross plane extends perpendicularly with respect to the formlining plane and centrally between two further parallel lateral outer edges of the panel formwork element, wherein the tie hole plane and the cross plane are disposed perpendicularly with respect to each other. In this case, the panel formwork elements (and the correspondingly designed inner corner element) may also be used being rotated through 180°. Thus, false mounting is prevented.

In another preferred embodiment, the inner limbs of the inner corner element are rigidly connected to each other, in particular, wherein the two inner limbs are formed together in one piece. This is particularly robust.

Corner Arrangements

Within the scope of the present invention is also a panel formwork corner arrangement, comprising an above-mentioned inventive panel formwork corner system, characterized in that the outer corner element and the inner corner element are oriented in such a fashion that the formlinings of the outer limbs and inner limbs are arranged pairwise in parallel in each case, the formlinings of the panel formwork elements and the formlinings of the outer limbs are disposed pairwise in the same plane in each case, and the lateral outer edge of each inner limb, which faces away from the other inner limb of the inner corner element, and a lateral outer edge of a panel formwork element are aligned with each other in each case. The inventive panel formwork corner arrangement can be used to directly produce the area of a corner of a concrete wall. The outer corner element and the bordering rectangular panel formwork elements together determine the outer border of the concrete wall, and the inner corner element determines the inner border. Panel formwork elements with centrally lined up tie holes may join the corner arrangement.

In a preferred embodiment of the inventive panel formwork corner arrangement, at least one rectangular panel formwork compensation element is provided between an outer limb and a panel formwork element, wherein the formlinings of the panel formwork element, compensation element and outer limb are disposed in one plane. Two panel formwork compensation elements are typically provided, one for each outer limb. With the panel formwork compensation elements, the wall thickness can be adjusted.

In another preferred embodiment, the separations between the formlinings of the outer limbs and the inner limbs, which are disposed in parallel to each other, are identical. In this case, the wall thickness at both limbs is the same, which is often required in practice.

Inventive Panel Formwork T-Shaped Intersection System

Within the scope of the present invention is also a panel formwork T-shaped intersection system, comprising a) a first and a second panel formwork inner corner element, wherein each inner corner element is formed with two inner limbs that are connected to each other and arranged at an angle with respect to each other, wherein the outer side of each inner limb has a flat formlining, wherein the formlinings of the two inner limbs subtend an angle $\alpha 1$, wherein an inner side of each inner limb has a frame section which extends along a lateral outer edge of the inner limb, which faces away from the respectively other inner limb, wherein each inner limb has at least one tie hole that extends through the formlining of the inner limb, wherein all tie holes of an inner limb are respectively disposed at a separation from the frame section of this inner limb, b) at least one rectangular panel formwork compensation element that has no tie holes, c) a first and a second rectangular panel formwork element, wherein each panel formwork element is formed with a flat formlining on a front side of the panel formwork element, with a circumferential frame on a rear side of the panel formwork element, with at least one tie hole that extends through the formlining, wherein all tie holes of a panel formwork element are disposed in one common tie hole plane, wherein this tie hole plane extends centrally between two parallel lateral outer edges of the rectangular panel formwork element and perpendicularly with respect to the formlining plane of the panel formwork element, and wherein all tie holes of a panel formwork element are disposed at a separation from the circumferential frame, wherein the position of each tie hole of a first inner limb of the first inner corner element with respect to three lateral outer edges of the inner limb corresponds to the position of a tie hole of a first inner limb of the second inner corner element with respect to three lateral outer edges of the inner limb and vice versa, wherein the position of each tie hole of a second inner limb of the first inner corner element with respect to three lateral outer edges of the inner limb corresponds to the position of a tie hole of the first panel formwork element with respect to three lateral outer edges of the panel formwork element and vice versa, and wherein the position of each tie hole of a second inner limb of the second inner corner element with respect to three lateral outer edges of the inner limb corresponds to the position of a tie hole of the second panel formwork element with respect to three lateral outer edges of the panel formwork element and vice versa.

The inventive panel formwork T-shaped intersection system is used to produce a T-shaped intersection of a concrete wall. It is moreover designed to be continued at the inner limbs and the panel formwork elements by means of further panel formwork elements with centrally lined up tie holes. These continuing panel formwork elements are of the same type as the rectangular panel formwork elements of the inventive panel formwork T-shaped intersection system.

The inventive panel formwork T-shaped intersection system realizes central anchorage in the area of a T-shaped intersection analogously to the inventive panel formwork corner system with all associated above-described advantages.

Tie holes are formed only in pairs at corresponding relative positions on formlinings that are disposed opposite to each other in the mounted state, i.e. the formlinings of the first inner limb of the first inner corner element and first inner limb of the second inner corner element, second inner limb of the first inner corner element and first panel formwork element, and second inner limb of the second inner corner element and second panel formwork element. Each tie hole in one formlining has a tie hole in the opposite formlining, which has the same separation from three lateral outer edges as the first. There are, in particular, no tie holes without such a correspondence in any one of the formlinings. All tie holes are disposed at a separation from the circumferential frame or frame section, in particular, at a clear separation from the circumferential frame or frame section (i.e. a separation of 8 cm or more between the frame inner edge and tie hole axis). In consequence of the position of the tie holes in the overall panel formwork T-shaped intersection system, all tie holes can actually be used for anchorage. The placing of stoppers is not required. All tie holes have a sufficient separation from the tie holes of neighboring components such that the tie plates do not overlap. A homogeneous anchor pattern is generated. The tie hole diameter can be freely selected independently of the frame thickness.

Embodiments of the Inventive T-Shaped Intersection System

In a preferred embodiment of the inventive panel formwork T-shaped intersection system, an overall of two or three panel formwork compensation elements are provided, which can be arranged between the panel formwork elements and/or other panel formwork compensation elements. The panel formwork compensation elements can be used to adjust the thickness (wall thickness) of the abutting wall. With three panel formwork compensation elements, a pleasant symmetry can be obtained.

In a preferred embodiment, $\alpha 1=90°$ applies for both inner corner elements. In this case, the abutting wall perpendicularly contacts the continuous wall. As an alternative, the two angles $\alpha 1$ of the inner corner elements may supplement each other to form an angle of 180°, but not be 90°. In that case, the abutting wall contacts the continuous wall at a corresponding angle.

In one particularly preferred embodiment, the tie holes of the panel formwork elements are disposed mirror-symmetrically with respect to a cross plane of the respective panel formwork element, wherein the cross plane extends perpendicularly with respect to the formlining plane and centrally between two further parallel lateral outer edges of the panel formwork element, wherein the tie hole plane and the cross plane are disposed perpendicularly with respect to each other. In this case, the panel formwork elements may similarly be used being rotated through 180°. False mounting is thereby prevented. The tie hole positions in the associated inner limbs are correspondingly adjusted.

In another preferred embodiment, the inner limbs of the inner corner elements are respectively rigidly connected to each other, in particular, wherein the two inner limbs of each inner corner element together are formed in one piece in each case. This is particularly robust.

Panel Formwork T-Shaped Intersection Arrangements

Within the scope of the present invention is also a panel formwork T-shaped intersection arrangement comprising an above-described inventive panel formwork T-shaped intersection system, characterized in that

- the inner corner elements are oriented in such a fashion that the formlinings of the second inner limbs and the panel formwork elements are oriented pairwise in parallel in each case,
- the formlinings of the panel formwork elements and all compensation elements are disposed in one plane;
- the lateral outer edges of the two first inner limbs are aligned with each other, wherein these lateral outer edges face away from the respectively other inner limb of the inner corner element,
- the lateral outer edge of the second inner limb of the first inner corner element which faces away from the other inner limb is aligned with a lateral outer edge of the first panel formwork element;
- and the lateral outer edge of the second inner limb of the second inner corner element which faces away from the other inner limb is aligned with a lateral outer edge of the second panel formwork element.

The inventive panel formwork T-shaped intersection arrangement permits direct production of the area of a T-shaped intersection of a concrete wall. The first inner limbs together delimit the abutting wall and the second inner limbs and the bordering panel formwork and compensation elements together delimit the continuous wall. The T-shaped intersection arrangement may be followed by panel formwork elements with centrally lined up tie holes.

In one preferred embodiment of the inventive panel formwork T-shaped intersection arrangement, the separations between the formlinings of the inner limbs and the panel formwork elements, which are disposed parallel to each other, are the same, which obtains a uniform wall thickness.

In another preferred embodiment, all panel formwork compensation elements are disposed between the panel formwork elements and/or further compensation elements, wherein the formlinings of the panel formwork elements and all compensation elements are in a common plane. The compensation elements can be used to adjust the thickness of the abutting wall.

In one particularly preferred embodiment, a reinforcing bar is provided, which engages behind the two panel formwork elements and the at least one panel formwork compensation element. This stabilizes the arrangement, in particular, when particularly thick or high concrete walls are to be produced.

Further advantages of the invention can be extracted from the description and the drawing. The features mentioned above and below may be used in accordance with the invention either individually or collectively in arbitrary combination. The embodiments shown and described are not to be understood as exhaustive enumeration but have exemplary character for describing the invention.

The invention is shown in the drawing and explained in more detail with reference to embodiments.

DESCRIPTION OF THE PREFERRED EMBODIMENT

The present invention provides specific component systems for a panel formwork based on "central anchorage". Central anchorage implies that all tie holes of a rectangular panel formwork element are respectively lined up on an anchor plane that extends centrally between two lateral parallel outer edges and perpendicularly to the formlining plane of the panel formwork element. Such panel formwork elements are described in the pending German patent application 10 2007 004 225.8.

With the inventive panel formwork corner system and the inventive panel formwork T-shaped intersection system corners and T-shaped intersections of concrete walls can be produced, wherein the principle of central anchorage can be maintained even in the area of the corner or T-shaped intersection. The central anchorage offers several advantages: 1) all tie holes can be used for anchoring. Positioning of stoppers is not required. This simplifies erection of a panel formwork, in particular, false mounting is prevented. 2) the tie hole diameter and thereby the strength of the anchorage can be freely selected. This enables, in particular, stronger anchoring at negligible additional cost. 3) the anchor pattern on exposed concrete walls is considerably improved. All these advantages are combined with the flexibility of a panel formwork.

Figure 1:
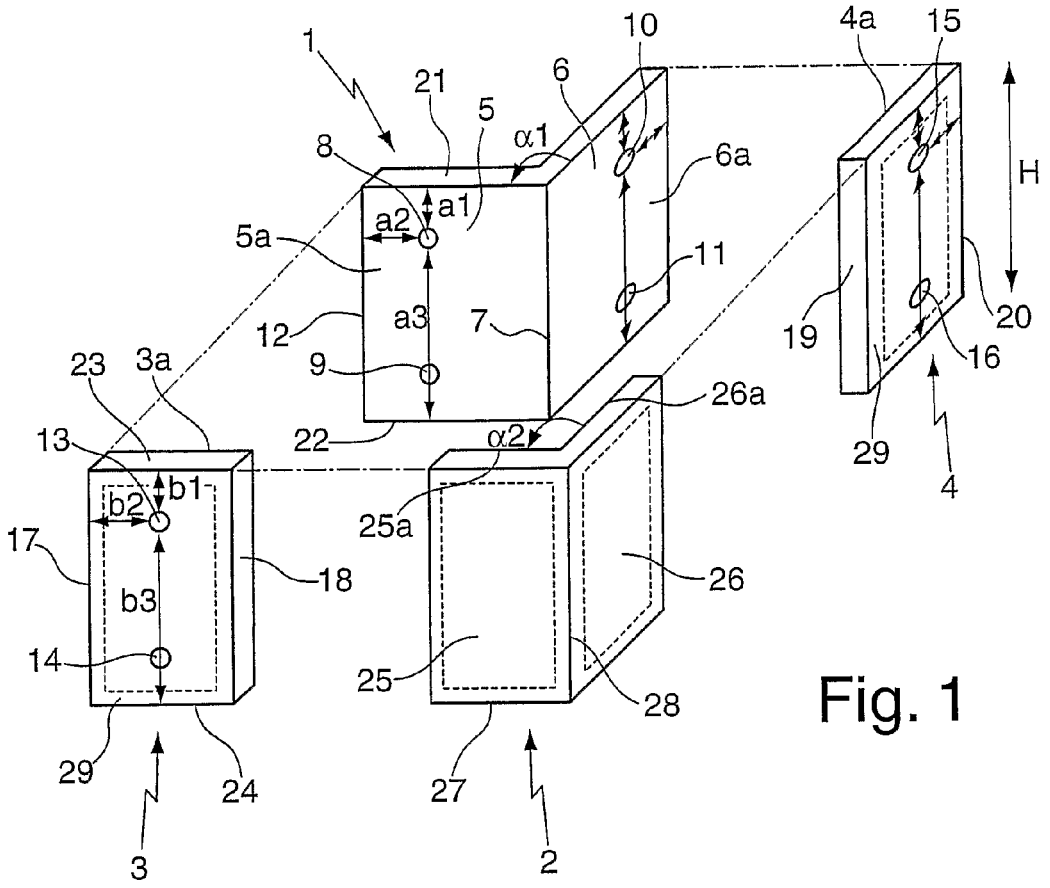
FIG. 1 shows a schematic exploded view of an embodiment of an inventive panel formwork corner arrangement.

FIG. 1 shows an exploded view of an inventive panel formwork corner arrangement. The associated arranged inventive panel formwork corner system comprises a panel formwork inner corner element 1, a panel formwork outer corner element 2, and two rectangular panel formwork elements 3, 4. In the mounted state, the panel formwork elements 3, 4 directly border on the outer corner element 2 and are closer to the inner corner element (compare FIG. 3). All components of the panel formwork corner arrangement have the same height H.

The inner corner element 1 has two inner limbs 5, 6, the outer sides of which (sides facing the viewer) each have a flat formlining 5*a*, 6*a*. The formlinings 5*a*, 6*a* abut each other at a common outer edge 7 and subtend an angle $\alpha$1 of 90°. The two inner limbs 5, 6 are mirror-symmetrically designed and are formed together in one piece.

Two tie holes 8, 9 and 10, 11, respectively, extend perpendicularly through the formlinings 5*a*, 6*a*. The tie holes 8, 9 of the inner limb 5 are lined up parallel with respect to a lateral outer edge 12 and parallel with respect to the common outer edge 7. The tie holes are (in the present case) closer to the outer edge 12 than to the outer edge 7. The tie holes 10, 11 of the inner limb 6 are lined up in a similar fashion.

Tie holes 13, 14, and 15, 16 are also formed in the panel formwork elements 3, 4. The tie holes 13, 14 of the panel formwork element 3 lie on a common tie hole plane that extends centrally between two parallel lateral outer edges 17, 18 of the panel formwork element 3 and perpendicularly with respect to the formlining plane (the formlining 3*a* faces away from the viewer) of the panel formwork element 3 (see in this respect FIG. 9). Similarly, the tie holes 15, 16 lie on a common tie hole plane that extends centrally between the parallel lateral outer edges 19, and perpendicularly with respect to the formlining plane 4*a* of the panel formwork element 4.

The tie hole positions of the tie hole 8 in the inner limb 5 and of the tie hole 13 in the panel formwork element 3 correspond to each other. This means that the separations a1, a2 and a3 between the tie hole 8 and the three lateral outer edges 21 (upper edge), 12 (left-hand outer edge that faces away from the other inner limb 6) and 22 (lower edge) of the inner limb 5 are identical to the separations b1, b2, and b3 between the tie hole 13 and the lateral outer edges 23 (upper edge), 17 (left-hand outer edge) and 24 (lower edge) of the panel formwork element 3.

Similarly, the positions of the tie holes 9 and 14, of tie holes 10 and 15 and of tie holes 11 and 16 correspond to each other.

Anchorage with a tie rod (not shown) is realized through corresponding tie holes (e.g. tie holes 8, 13).

The outer corner element 2 comprises two outer limbs 25, 26. Flat formlinings 25*a*, 26*a* are respectively provided on the inner sides of the outer limbs (facing away from the viewer), with the formlinings 25*a*, 26*a* subtending an angle $\alpha$2 of 90°. The outer corner element 2 is reinforced on the rear side by a circumferential frame 27 that additionally also extends on an outer corner edge 28. The outer corner element 2 is mirror-symmetrical with respect to the outer limbs 25, 26.

The panel formwork elements 3, 4 are also reinforced on their rear sides by means of a circumferential frame 29.

Figure 3:
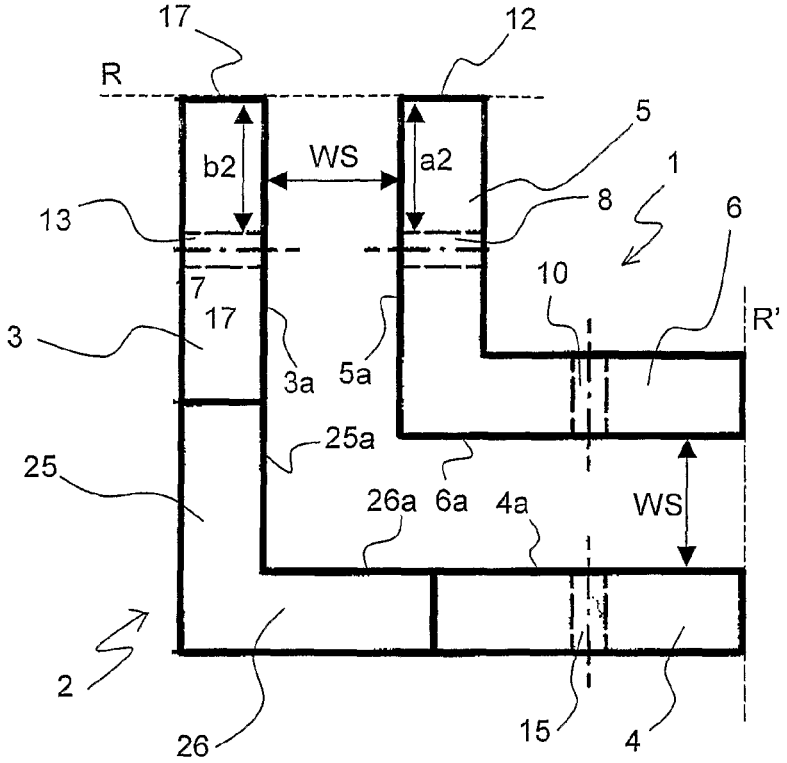
FIG. 3 shows a schematic cross-section through the embodiment of an inventive panel formwork corner arrangement of FIG. 1 with small wall thickness.

The dash-dotted line in FIG. 1 indicates aligned edges (see in this connection FIG. 3).

Figure 2:
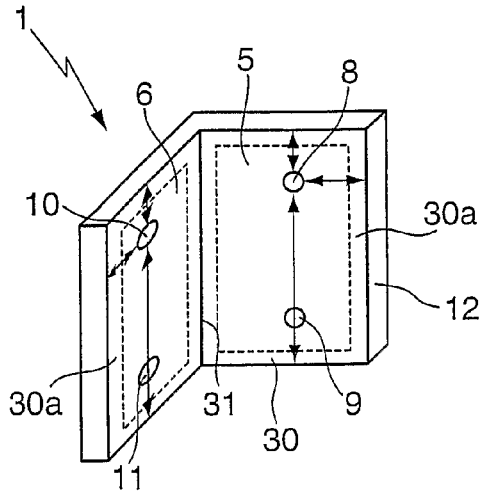
FIG. 2 shows a schematic inclined view of an inner corner element for the invention.

FIG. 2 shows the inner corner element 1 of FIG. 1 from the rear side. The rear side of the inner corner element 1 also has a circumferential frame 30 which is additionally reinforced in the area of a corner edge 31. Part of the frame 30, i.e. the formwork sections 30*a*, are required for bracing the neighboring panel formwork elements. A frame section 30*a* of this type extends on that lateral outer edge 12 of the inner limb 5 that faces away from the other inner limb 6 (illustrated for the right-hand inner limb 5).

The tie holes 8, 9, 10, 11 are all clearly spaced apart from the frame 30.

It should be noted that an inner corner element of an inventive panel formwork T-shaped intersection system has the same construction as the inner corner element 1.

FIG. 3 shows a schematic horizontal cross-section through the inventive panel formwork corner arrangement of FIG. 1 at the level of the upper tie holes.

The formlining 5*a* of the inner limb 5 of the inner corner element 1 is disposed opposite and parallel with respect to the formlining 3*a* of the panel formwork element 3 and parallel (but only along a small fraction directly opposite) with respect to the formlining 25*a* of the outer limb 25 of the outer corner element 2. This applies accordingly to the formlinings 6*a*, 4*a* and 26*a*. The lateral outer edges 12, 17 of the inner limb 5 and the panel formwork element 3 are aligned, i.e. they terminate on a common edge plane R that extends perpendicularly with respect to the planes of the formlinings 5*a*, 3*a*. The same applies for the corresponding outer edges of the inner limb 6 and the panel formwork element 4 at the edge plane R'.

The tie holes 8, 13 are disposed directly opposite to each other, in particular, the separations a2 and b2 from the outer edges 12 and 17 are identical. The same applies to the tie holes 10 and 15.

Figure 4:
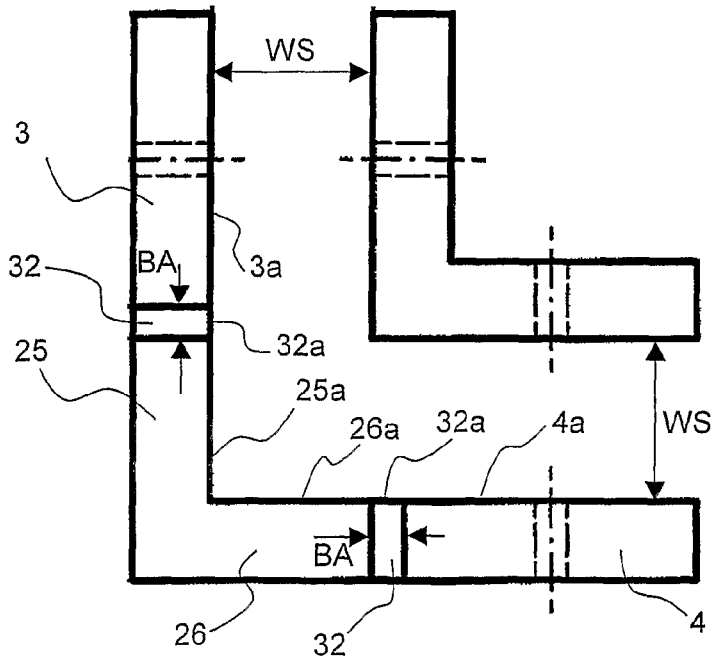
FIG. 4 shows a schematic cross-section through an embodiment of an inventive panel formwork corner arrangement with large wall thickness with two panel formwork compensation elements.

The panel formwork corner system of FIG. 3 can produce only one wall thickness WS (or one separation between the formlinings 5*a*, 3*a*, and 6*a*, 4*a*) when alignment of the outer edges (e.g. 12, 17) shall be ensured. However, other wall thicknesses can be adjusted by means of second additional panel formwork compensation elements 32 as shown in FIG. 4.

The panel formwork compensation elements 32 are disposed between the outer limbs 25, 26 and the panel formwork elements 3, 4 and increase the wall thickness WS by their width BA.

If only one compensation element 32 was used, the wall thickness WS would change at the corner. This can also be realized by the present invention.

Towards the wall to be cast, the compensation elements 32 terminate with a flat surface 32*a* in the plane of the neighboring formlinings 3*a*, 4*a*, 25*a*, 26*a*. The compensation elements 32 are typically produced from solid wood, steel or aluminum and may comprise a formlining.

Figure 5:
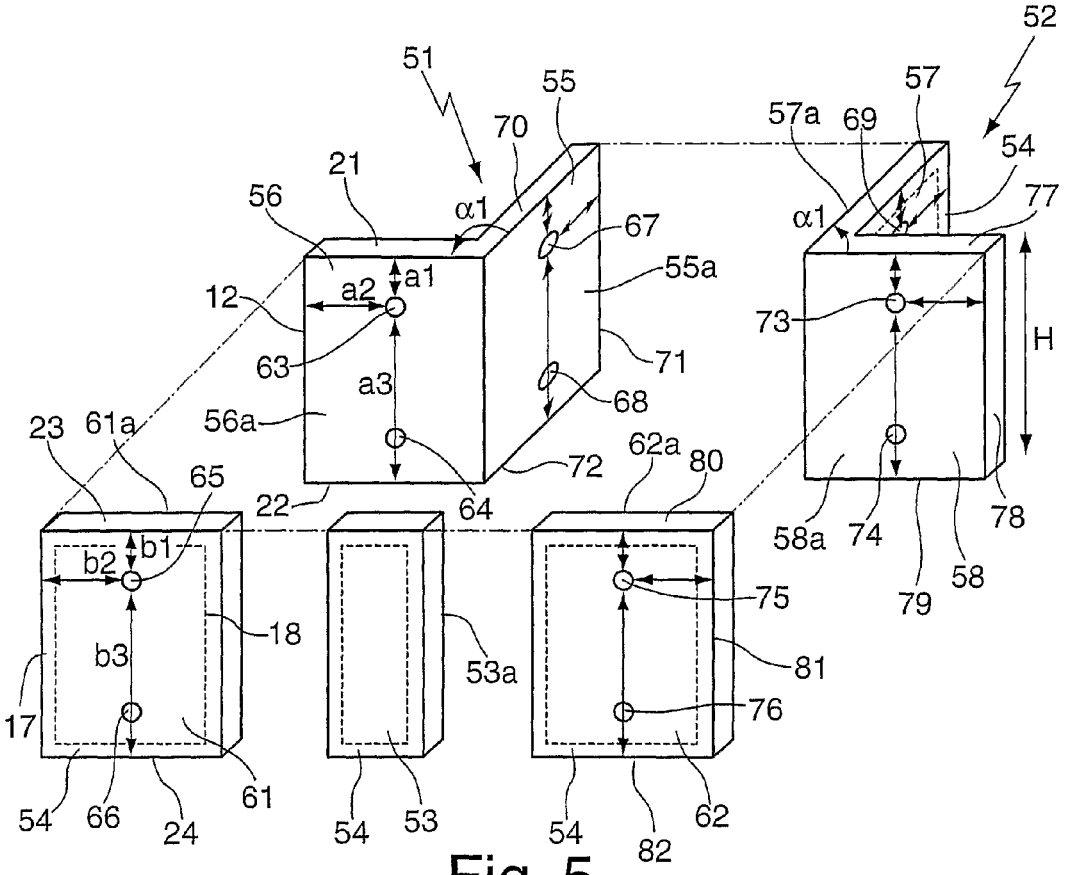
FIG. 5 shows a schematic exploded view of an embodiment of an inventive panel formwork T-shaped intersection arrangement.

FIG. 5 shows a schematic exploded view of an inventive panel formwork T-shaped intersection arrangement, comprising an inventive panel formwork T-shaped intersection system with two panel formwork inner corner elements 51, 52, two rectangular panel formwork elements 61, 62 and a panel formwork compensation element 53. In the mounted state, the panel formwork elements 61, 62 directly border on the compensation element 53, the inner corner elements 51, 52 are closer together and the inner corner element 51, 52 are closer to the panel formwork elements 61, 62 (see FIG. 6).

Each component 51, 52, 53, 61, 62 has the same height H and a circumferential frame 54 on its rear side. The inner corner elements 51, 52 are structured as shown in FIG. 2.

The first inner corner element 51 has a first inner limb 55 and a second inner limb 56. The formlinings 55*a*, 56*a* thereof on the front side (facing the viewer) intersect at an angle $\alpha 1$ of 90°. The second inner corner element 52 has a first inner limb 57 and a second inner limb 58. The formlinings 57*a*, 58*a* thereof (the formlining 57*a* of the first inner limb 57 faces away from the viewer) also intersect at an angle of $\alpha 1$ of 90°.

The first panel formwork element 61 has a flat formlining 61*a*, the second panel formwork element 62 has a flat formlining 62*a* and the panel formwork compensation element 53 has a flat formlining 53*a* (in each case facing away from the viewer).

The formlinings 56*a* and 61*a* are opposite to each other and oriented in parallel with respect to each other. Both formlinings have tie holes 63, 64, and 65, 66, the relative positions of which correspond to each other. The tie hole 63 in the inner limb 56 has separations a1, a2, a3 from the three lateral outer edges 21 (upper edge), 12 (left-hand outer edge, facing away from the other inner limb 55), and 22 (lower edge). The tie hole 65 in the first panel formwork element 61 has separations b1, b2, b3 from the three lateral outer edges 23 (upper edge), 17 (left-hand outer edge) and 24 (lower edge). a1=b1 and a2=b2 and a3=b3. Similarly, the tie hole positions of the tie holes 64 and 66 also correspond to each other.

The formlinings 55*a* and 57*a* are parallel and opposite to each other. The relative position of the tie hole 67 with respect to the separations from the outer edges 70 (upper edge), 71 (lateral outer edge that faces away from the other inner limb 56), 72 (lower edge) in the formlining 55*a* corresponds to the position of the tie hole 69 in the formlining 57*a*. The tie hole in the formlining 57*a* that corresponds to the tie hole 68 in the formlining 55*a* is covered in FIG. 5.

The formlinings 58*a* and 62*a* are moreover opposite and parallel with respect to each other. The relative position of the tie hole 73 of the second inner limb 58 with respect to the separations from the outer edges 77 (upper edge), 78 (right-hand outer edge that faces away from the other inner limb 57), 79 (lower edge) corresponds to the tie hole 75 of the second panel formwork element 62 with respect to the outer edges 80, 81, 82. The tie hole 76 corresponds to the tie hole 74.

Anchorage with a tie rod (not shown) is realized through tie holes (e.g. tie holes 63, 65) that correspond to each other.

Figure 6:
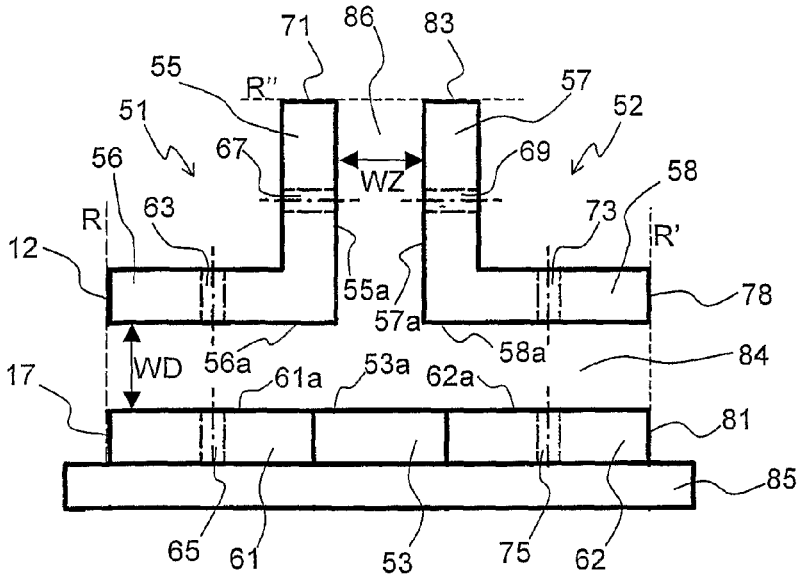
FIG. 6 shows a schematic cross-section through the embodiment of an inventive panel formwork T-shaped intersection arrangement of FIG. 5 with small wall thickness.

The dash-dotted line in FIG. 5 indicates aligned edges (compare FIG. 6).

FIG. 6 shows a schematic cross-section through the inventive panel formwork T-shaped intersection arrangement of FIG. 5 at the level of the upper tie holes.

The panel formwork elements 61, 62 directly border on the intermediate panel formwork compensation element 53. The associated formlinings 61*a*, 53*a*, 62*a* are in one plane. These formlinings 61*a*, 53*a*, 62*a* delimit on one side the continuous wall 84 of the T-shaped intersection to be produced. The three components 61, 53, 62 are engaged from behind by a crossbar 85 for mechanical stabilization. The two formlinings 55*a*, 57*a* delimit on both sides the abutting wall 86 of the T-shaped intersection to be produced.

The lateral outer edges 12 and 17 of the inner limb 56 and the panel formwork element 61 are aligned with respect to each other at the edge plane R. The outer edges 78 and 81 of the inner limb 58 and the panel formwork element 62 are also aligned with respect to each other at the edge plane R'. Finally, the outer edges 71 and 83 of the inner limb 55 and inner limb 57 are also aligned with respect to each other at the plane R".

The pairwisely corresponding tie holes 63 and 65, further 73 and 75, and also 67 and 69 are disposed directly opposite to each other.

The wall thickness WD of the continuous wall 84 can be adjusted by means of the separation between the two inner corner elements 51, 52 and the panel formwork elements 61, 62 and the compensation element 53. The wall thickness WZ of the abutting wall 86, however, is determined by the width of the compensation element 53.

Figure 7:
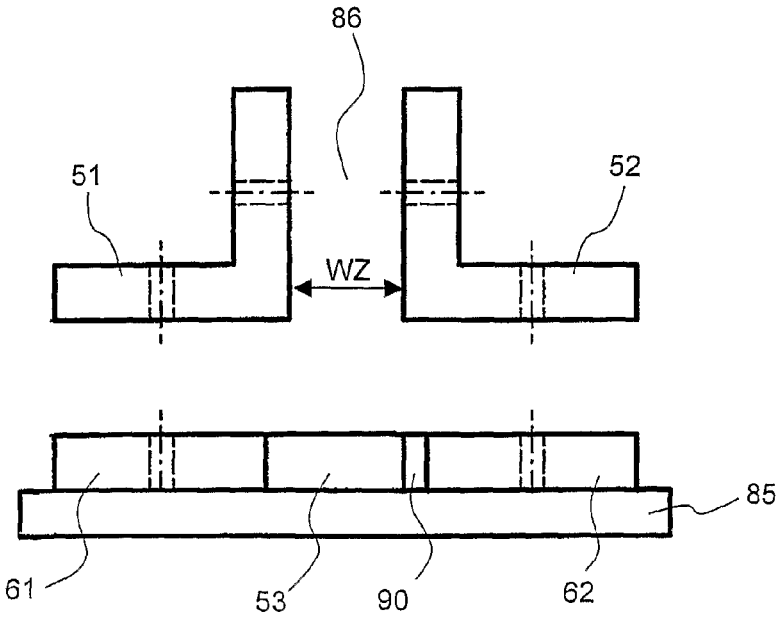
FIG. 7 shows a schematic cross-section through an embodiment of an inventive panel formwork T-shaped intersection arrangement having a medium wall thickness and two panel formwork compensation elements.
Figure 8:
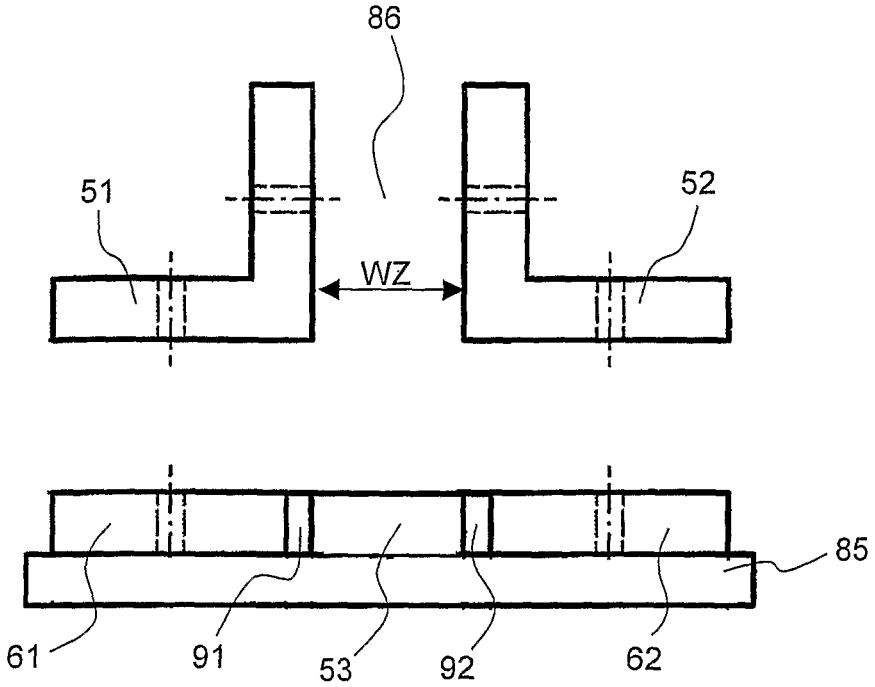
FIG. 8 shows a schematic cross-section through an embodiment of an inventive panel formwork T-shaped intersection arrangement having a large wall thickness and three panel formwork compensation elements.

There are two ways of adjusting different wall thicknesses WZ of the abutting wall 86: 1) one individual special compensation element 53 is provided for each desired wall thickness; or 2) the compensation element 53 is supplemented by one or more additional compensation elements 90, 91, 92, typically with standardized widths. This second possibility is illustrated in FIGS. 7 and 8. The additional compensation elements 90-92 are produced e.g. from solid wood and are also engaged behind by the crossbar 85. The thickness of all walls was enlarged in equal measure in FIGS. 7 and 8, respectively. The other components 51, 52, 61, 62, 53 correspond to the embodiment of FIG. 6.

Figure 9:
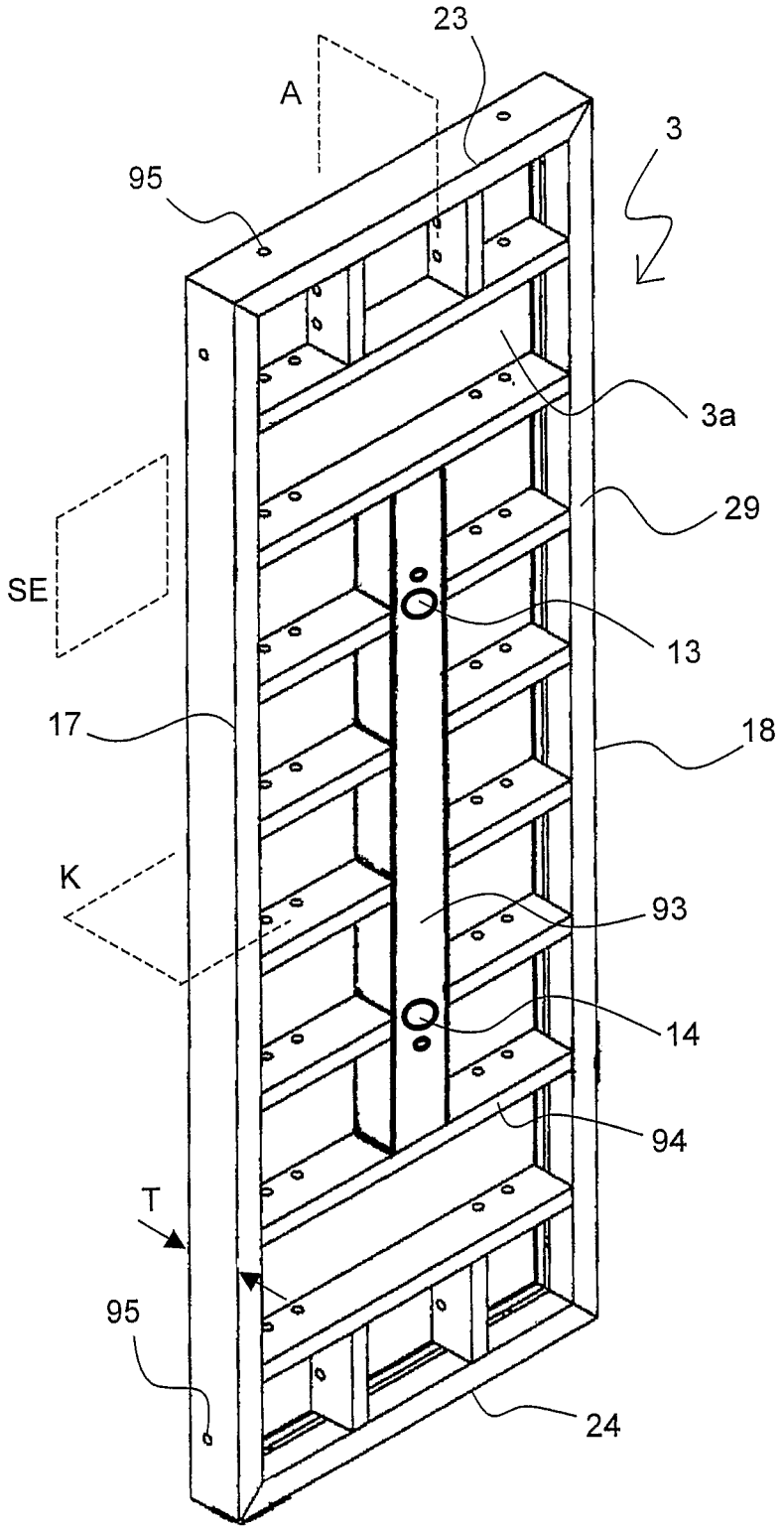
FIG. 9 shows a schematic perspective inclined rear view of a rectangular panel formwork element with centrally lined up tie holes for the invention.

FIG. 9 finally shows a typical panel formwork element 3 with centrally lined up tie holes 13, 14, which can be used both in an inventive panel formwork corner system and in an inventive panel formwork T-shaped intersection system. The illustrated panel formwork element 3 may also be used to continue a panel formwork starting from an inventive panel formwork corner system or panel formwork T-shaped intersection system.

The panel formwork element 3 has a flat formlining 3*a* (facing away from the viewer) on its front side and a circumferential frame 29 on its rear side. The rear side also has a reinforcing element 93 and different reinforcing struts 94. Two tie holes 13, 14 run in the reinforcing element 93 and through the formlining 3.

All tie holes 13, 14 are lined up on a tie plane A that extends between the parallel lateral outer edges 17 and 18 at an identical separation therefrom and perpendicularly with respect to the formlining plane SE. The tie holes 13, 14 are moreover disposed mirror-symmetrically with respect to a cross plane KE that extends between the further parallel lateral outer edges 23, 24 at an identical separation therefrom and perpendicularly with respect to the formlining plane SE. The panel formwork element 3 has no clamping supports, all load-bearing elements (frame 29, reinforcing element 93 and reinforcing struts 94) terminate in a plane that is parallel to the formlining 3*a* at a separation T. For this reason, the panel formwork elements 3 can be easily stacked.

The circumferential frame 29 moreover comprises some bores 95 that extend in a perpendicular direction through the circumferential frame 3 and parallel to the formlining plane SE. Neighboring panel formwork elements 3 can be mounted to each other via these bores 95. The bores 95 moreover facilitate stacking and unstacking of the panel formwork elements 3 with a corresponding chain suspension.

It should be noted that the panel formwork elements with centrally lined up tie holes may also have only one tie hole or three or even more tie holes, which are all disposed on the tie hole plane A.

In summary, the present invention describes panel formwork systems of several components, including panel formwork elements with centrally lined up tie holes, which can be used to form wall structures on the basis of central anchorage, with the wall structures exceeding a simple wall. In each case, one important component for all these systems is an inner corner element, which corresponds with at least one limb with respect to its tie hole positions to an associated aligned panel formwork element with centrally lined up tie holes. This also allows utilization or continuation of a central anchorage even at corner positions (genuine corners, T-shaped intersections).

I claim:

1. A panel formwork T-shaped intersection arrangement, the arrangement comprising:

a first and a second panel formwork inner corner element, each inner corner element being formed with two inner limbs that are connected to each other and disposed at an angle with respect to each other, wherein an outer side of each inner limb has a flat formlining, the formlinings of the two inner limbs subtending an angle $\alpha$1, wherein each inner limb has a frame section on an inner side thereof, which extends along a lateral outer edge of the inner limb which faces away from the respectively other inner limb, each inner limb having at least one tie hole that extends through the formlining of the inner limb, wherein all tie holes of an inner limb are respectively disposed at a separation from the frame section of that inner limb;

at least one rectangular panel formwork compensation element that has no tie holes; and a first and a second rectangular panel formwork element, each panel formwork element having a flat formlining on a front side of the panel formwork element and a circumferential frame on a rear side thereof, and with at least one tie hole that extends through the formlining, wherein all tie holes of a panel formwork element are disposed in a common tie hole plane extending centrally between two parallel lateral outer edges of the rectangular panel formwork element and perpendicularly with respect to a formlining plane of the panel formwork element, wherein all tie holes of a panel formwork element are disposed at a separation from the circumferential frame, a position of each tie hole of a first inner limb of the first inner corner element with respect to three lateral outer edges of that inner limb corresponding to a position of a tie hole of a first inner limb of the second inner corner element with respect to three later outer edges of that inner limb, wherein a position of each tie hole of a second inner limb of a first inner corner element with respect to three lateral outer edges of that inner limb corresponds to a position of a tie hole of the first panel formwork element with respect to three lateral outer edges of that panel formwork element, a position of each tie hole of a second inner limb of the second inner corner element with respect to three lateral outer edges of that inner limb corresponding to a position of a tie hole of the second panel formwork element with respect to three lateral outer edges of that panel formwork element, further comprising a total of two or three panel formwork compensation elements which are structured for disposition between the panel formwork elements and/or other panel formwork compensation elements, wherein the inner corner elements are oriented in such a fashion that the formlinings of the second inner limbs and the panel formwork elements are oriented pairwise in parallel, the formlinings of the panel formwork elements and all compensation elements being disposed in one plane, wherein lateral outer edges of the two first inner limbs are aligned with respect to each other, these lateral outer edges facing away from the respectively other inner limb of the inner corner element, the lateral outer edge of the second inner limb of the first inner corner element which faces away from the other inner limb being aligned with a lateral outer edge of the first panel formwork element and the lateral outer edge of the second inner limb of the second inner corner element which faces away from the other inner limb is aligned with a lateral outer edge of the second panel formwork element.

2. The panel formwork T-shaped intersection arrangement of claim 1, wherein $\alpha$1=90° applies for both inner corner elements.

3. The panel formwork T-shaped intersection arrangement of claim 1, wherein the tie holes of the panel formwork elements are disposed mirror-symmetrically with respect to a cross plane of a respective panel formwork element, the cross plane extending perpendicularly with respect to a formlining plane and centrally between two further parallel lateral outer edges of the panel formwork element, wherein a tie hole plane and the cross plane are disposed perpendicularly with respect to each other.

4. The panel formwork T-shaped intersection arrangement of claim 1, wherein the inner limbs of the inner corner elements are rigidly connected to each other or are integral with another.

5. The panel formwork T-shaped intersection arrangement of claim 1, wherein separations between the formlinings of the inner limbs and the panel formwork elements, which are disposed parallel with respect to each other, are identical.

6. The panel formwork T-shaped intersection arrangement of claim 1, wherein said panel formwork compensation elements are disposed between the panel formwork elements and/or further compensation elements, the formlinings of the panel formwork elements and all compensation elements lying in a common plane.

7. The panel formwork T-shaped intersection arrangement of claim 1, further comprising a reinforcing bar which engages behind the two panel formwork elements and the at least one panel formwork compensation element.

* * * * *